US005632049A

United States Patent [19]

Chen

[11] Patent Number: 5,632,049

[45] Date of Patent: May 27, 1997

[54] HOLDER ASSEMBLY FOR A SHOWER HEAD

[76] Inventor: Te-Sen Chen, No. 31 Alley 52, Lane 81, Shan-Chung St., Jang-Hua City, Taiwan

[21] Appl. No.: 591,017

[22] Filed: Jan. 25, 1996

[51] Int. Cl.[6] ..... A47K 7/04

[52] U.S. Cl. ..... 4/570; 4/605; 4/615; 248/124.2

[58] Field of Search ..... 4/567, 570, 605, 4/615; 248/124.2, 125.9; 239/282, 283

[56] References Cited

U.S. PATENT DOCUMENTS

| | | | |
|---|---|---|---|
| 4,174,822 | 11/1979 | Larsson | 4/615 |

FOREIGN PATENT DOCUMENTS

| | | | |
|---|---|---|---|
| 1370713 | 7/1964 | France | 4/615 |
| 2802168 | 7/1979 | Germany | 4/615 |
| 651609 | 9/1985 | Switzerland | 4/605 |
| 754123 | 8/1956 | United Kingdom | 4/615 |

*Primary Examiner*—Henry J. Recla
*Assistant Examiner*—Charles R. Eloshway
*Attorney, Agent, or Firm*—Morton J. Rosenberg; David I. Klein

[57] ABSTRACT

A holder assembly for a shower arm of a shower head includes a positioning body defining a vertical bore therein through which a vertical rod extends, which, in turn, is mounted to a wall of a bathroom. The positioning body includes an opening defined in an outer periphery thereof and communicated with the vertical bore, a pair of lugs formed on the outer periphery thereof and between which the opening is defined, and a lever pivotally connected to the lugs and including an operative end with an eccentric operative edge. A connecting part extends from the outer periphery of the positioning body. A shower arm holder includes a holder ring for removably holding a shower arm and is attached to the shower arm holder to the connecting part of the positioning body. The positioning body is frictionally held in position on the vertical rod when the lever is in a first, secured position. The positioning body is movable relative to the vertical rod when the lever is in a second, released position.

1 Claim, 8 Drawing Sheets

HOLDER ASSEMBLY FOR A SHOWER HEAD

BACKGROUND OF THE INVENTION

1. Field of the Invention

The present invention relates to a holder assembly for a shower head and, more particularly, to a holder assembly which is rotationally adjustable in addition to an adjustable height thereof.

2. Description of the Related Art

A shower head is a common utensil in bathrooms. A hand-held shower head provides a more convenient use than a fixed one, yet a disadvantage thereof is that a holder for holding a shower arm of the shower head is generally fixed to a wall of the bathroom. An adjustable holder assembly has been proposed to solve the above-mentioned problem, and a typical one is shown in FIGS. 7 and 8 of the drawings. The holder assembly includes a positioning member 50 which includes a transverse bore 51 through which a bar 40 extends, and a protrusion 53 projecting from a side of the positioning member 50 and having a threaded outer periphery, two ends of the bar 40 being securely attached to the wall of the bathroom. A longitudinal bore 52 is defined in the protrusion 53 and communicates with the transverse bore 51. An end cap 54 includes a threaded inner periphery for engaging with the threaded outer periphery of the protrusion 53 and a stub 57 defining a blind hole 56 therein. As shown in FIG. 8, a pin 54 is inserted into the longitudinal bore 52 and then the end cap 55 is mounted around the protrusion 53 by threading connection with a first end of the pin 54 bearing against an end wall of the stub 57 and with a second end of the pin 54 bearing against an outer periphery of the rod 40. A housing 60 is mounted around the positioning member 50 and has an end abutting against the end cap 55, as shown in FIG. 8. The housing 60 and has a compartment 65 for receiving the positioning member 53 via a first open side thereof and a bore 64 which aligns with the transverse bore 51 of the positioning member 50 received therein, thereby allowing the rod 40 to extend therethrough. Upon rotational movements of the end cap 55, the pin 54 is either moved rightwardly (from the direction of FIG. 8) to frictionally hold the rod 40 in position or moved leftwardly (also from the direction of FIG. 8) to allow adjustment of the positioning member 51 relative to the rod 40.

A shower arm holder 70 is mounted to the other side of the housing 60 via a connecting ring 61. As shown in FIG. 7, the shower arm holder 70 includes a hole 71 in a side thereof, and a positioning element 62 having a longitudinal hole is mounted to a side wall of the second side of the housing 60, the side wall having a hole (not labeled) aligning with the hole 71. A screw 63 is extended through the positioning element 62 and has a distal end received in the hole 71 to attach the shower arm holder 70 to the housing 60.

A disadvantage of the above-mentioned shower head holder assembly is that too many elements are used and the structure is too complicated, resulting in difficulty in manufacture and assembly, wasting labor hours and increasing costs. A further disadvantage of the above-mentioned shower head holder assembly is that, when rotational adjustments are required (e.g., the shower arm holder 70 is not in an upright position, or an angular position of the positioning member 50 with respect to the rod 40), the end cap 55 has to be loosened to allow rotational movements of the positioning member.

Therefore, there has been a long and unfulfilled need for an improved holder assembly for shower heads to mitigate and/or obviate the above problems.

SUMMARY OF THE INVENTION

A holder assembly for a shower arm of a shower head in accordance with the present invention includes a positioning body defining a vertical bore therein through which a vertical rod extends, which, in turn, is mounted to a wall of a bathroom. The positioning body includes an opening defined in an outer periphery thereof and in communication with the vertical bore, a pair of lugs formed on the outer periphery thereof and between which the opening is defined, and a lever pivotally connected to the lugs and including an operative end with an eccentric operative edge. The opening is substantially U-shaped, thereby forming a flexible piece therein. The eccentric operative edge exerts a force on the flexible piece so as to be frictionally held in position on the vertical rod when the lever is in a first, secured position. The positioning body is movable relative to the vertical rod both in a longitudinal direction of the vertical rod and in an angular direction with respect to the vertical rod when the eccentric operative edge is in a second, released position in which the eccentric operative edge disengages from the flexible piece.

The holder assembly further includes a connecting part extending from the outer periphery of the positioning body, a shower arm holder comprising a holder ring for removably holding a shower arm, and a means for attaching the shower arm holder to the connecting part of the positioning body.

In accordance with one aspect of the invention, the connecting part includes a ball-like structure, the shower arm holder includes a stub having a threaded outer periphery and a holder ring for removably holding the shower arm, and the attaching means includes a sleeve having an inwardly-projecting annular edge formed on a first end thereof and an open second end with inner threading and a retainer ring having a diameter slightly smaller than a diameter of the ball-like structure and made of resilient material. The ball-like structure is partially received in the first end of the sleeve and the retainer ring is mounted around the ball-like structure and adjacent to the inwardly-projecting annular edge to prevent the ball-like structure from disengaging from the sleeve, and the stub of the shower arm holder is threadedly connected with the open second end of the sleeve, thereby being attached to the ball-like structure and being universally adjustable relative to the ball-like structure.

Other objects, advantages, and novel features of the invention will become more apparent from the following detailed description when taken in conjunction with the accompanying drawings.

DESCRIPTION OF THE PREFERRED EMBODIMENT

Figure 1:
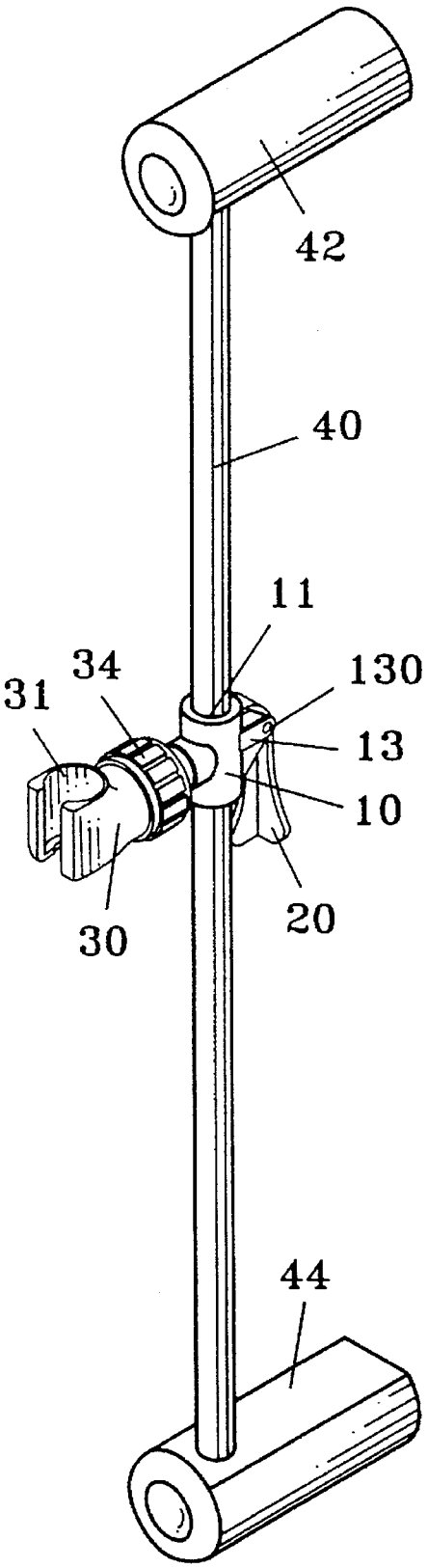
FIG. 1 is a perspective view of a shower head holder assembly in accordance with the present invention mounted to a vertical rod in a bathroom.

Referring to FIGS. 1 to 6, and initially to FIG. 1, a holder assembly for shower heads in accordance with the present invention is mounted to a vertical rod 40, which, in turn, is mounted to a wall of a bathroom (not shown), via two bars 42 and 44 respectively connected to upper and lower ends thereof. The holder assembly includes a substantially cylindrical positioning body 10 defining a vertical bore 11 therein through which the vertical rod 40 extends. An opening 12 (see FIG. 2) is defined in an outer periphery of the positioning body 10 and communicated with the vertical bore 11. The opening 12 is substantially U-shaped, thereby forming a flexible piece 120 therein.

Figure 2:
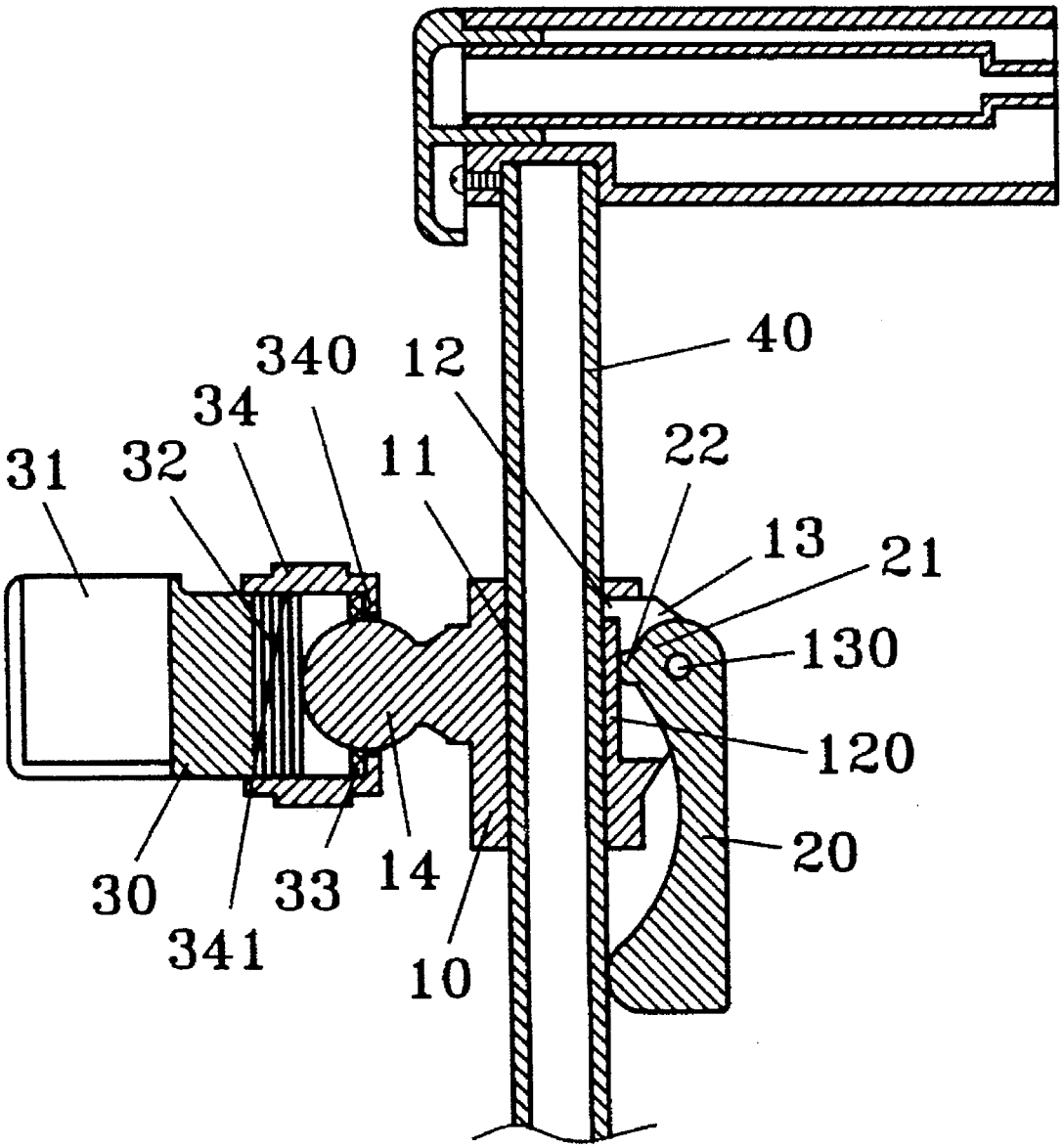
FIG. 2 is a cross-sectional view of the shower head holder assembly in accordance with the present invention and the associated vertical rod.
Figure 3:
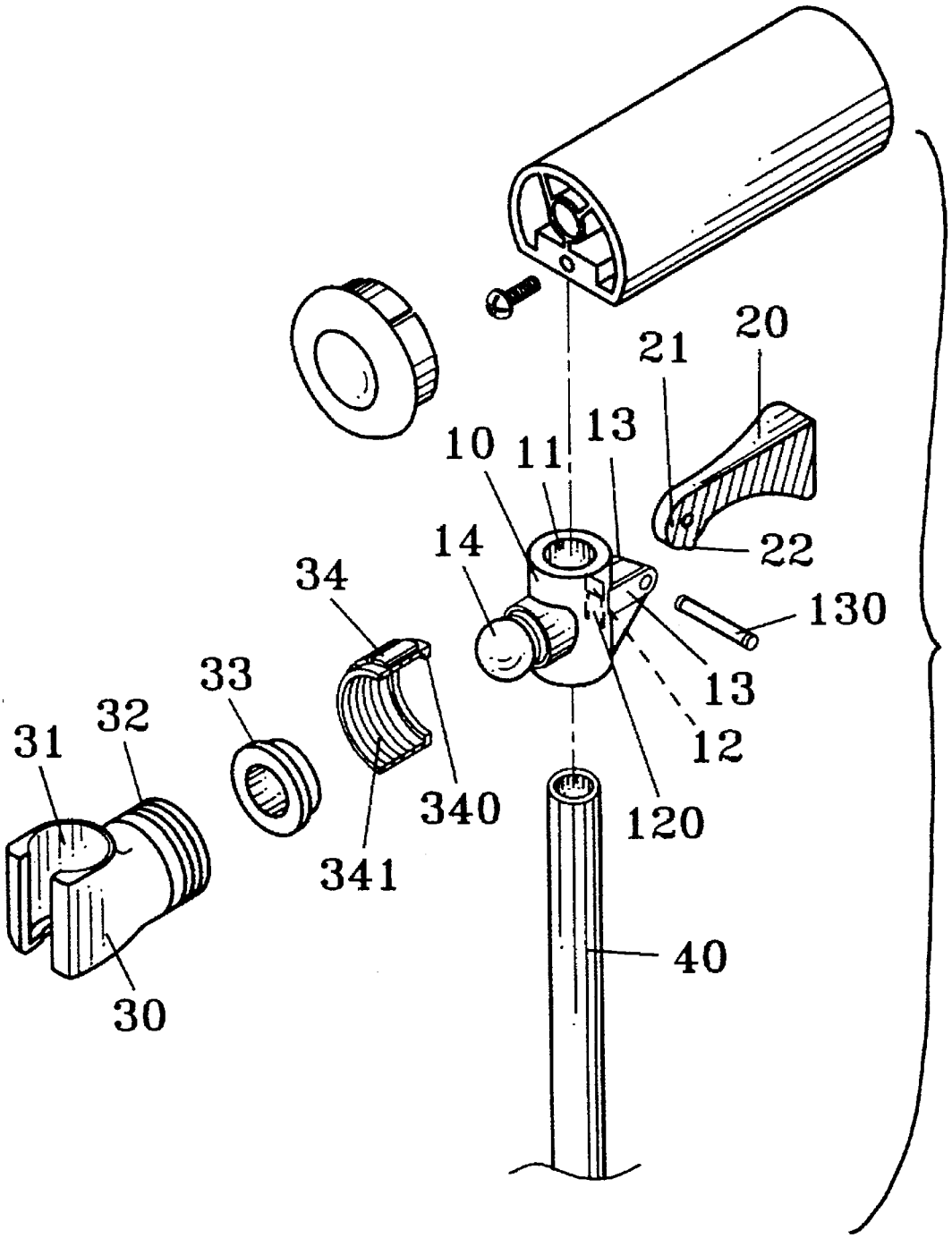
FIG. 3 is an exploded view of the shower head holder assembly in accordance with the present invention and the associated vertical rod.
Figure 4:
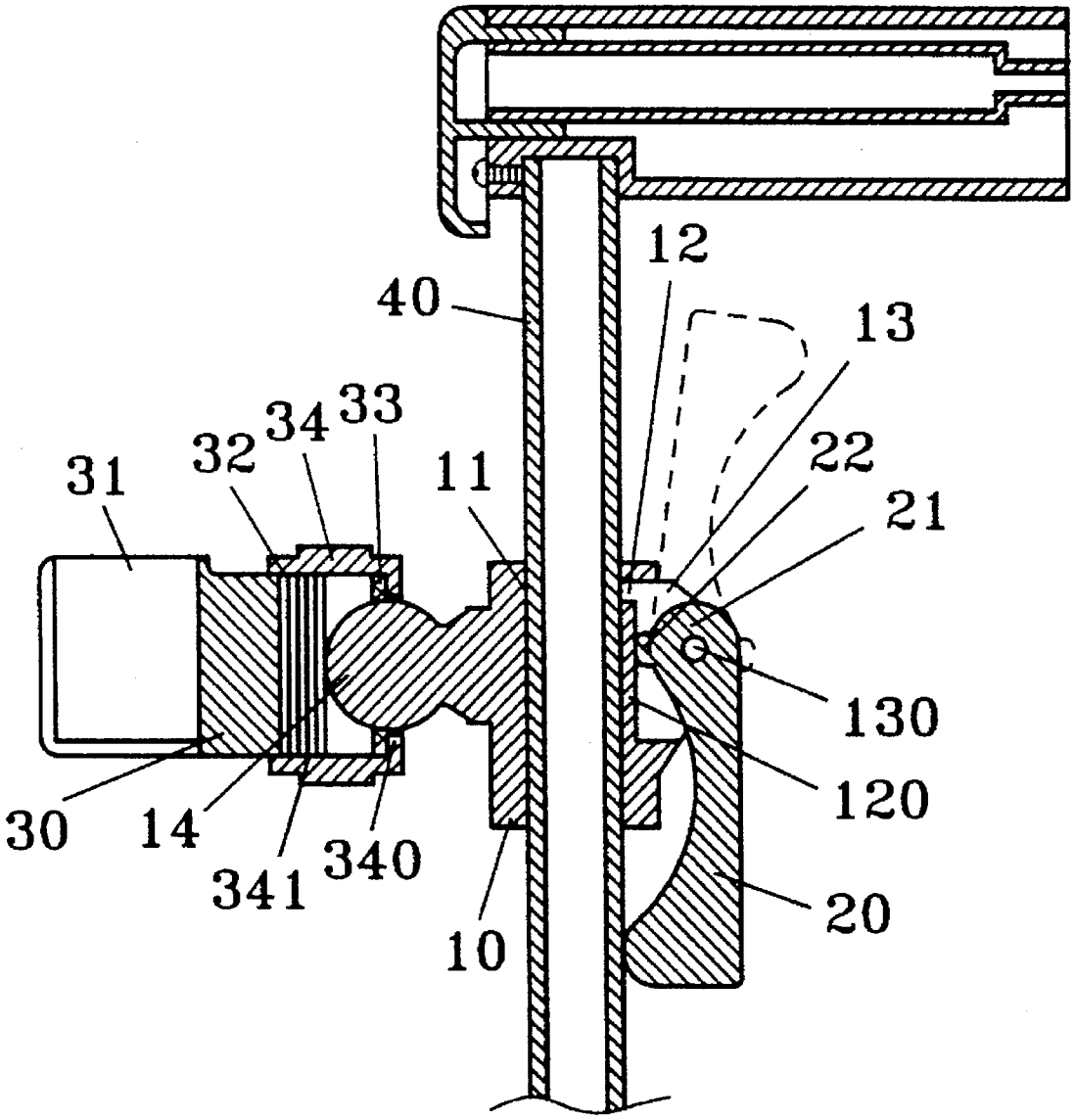
FIG. 4 is a cross-sectional view similar to FIG. 2, illustrating operation of a lever of the shower head holder assembly in accordance with the present invention.

Referring to FIGS. 2 and 3, a pair of lugs 13 are formed on the outer periphery of the positioning body 10 and between which the opening 12 is defined. A lever 20 is pivotally connected to the lugs 13 by a pin 130 and includes an operative end 21 with an eccentric operative edge 22, operation of which will be described later.

Still referring to FIGS. 2 and 3, a connecting part, e.g., a ball-like structure 14 extends from the outer periphery of the positioning body 10, and a shower arm holder 30 is attached to the ball-like structure 14 by a connecting means. The shower arm holder 30 includes a connecting portion, e.g., a stub 32 having a threaded outer periphery, and a substantially C-shape holder ring 31 for removably holding a shower arm of a shower head (not shown). The connecting means includes a sleeve 34 having an inwardly-projecting annular edge 340 formed on a first end thereof and an open second end with inner threading 341. The connecting means further includes a retainer ring 33.

In assembly, the lever 20 is placed between the lugs 13 and the pin 130 is extended through the lugs 13 and the lever 20, thereby pivotally connecting the lever 20 to the lugs 13. The sleeve 34 receives a part of the ball-like structure 14 via the first end thereof, and the retainer ring 33 is inserted into the sleeve 34 via the open second end of the sleeve 34 and then positioned around the ball-like structure 14 at a diametrical position of the ball-like structure 14. It is appreciated that the retainer ring has a diameter slightly smaller than a diameter of the ball-like structure 14, yet it is made of resilient material so as to pass over the ball-like structure 14 to bear against the inwardly-projecting annular edge 340, thereby preventing the sleeve 34 from disengaging from the ball-like structure 14. Thereafter, the shower arm holder 30 engages with the second end of the sleeve 34 by threading connection between the threaded stub 32 and the threading 341.

Figure 6:
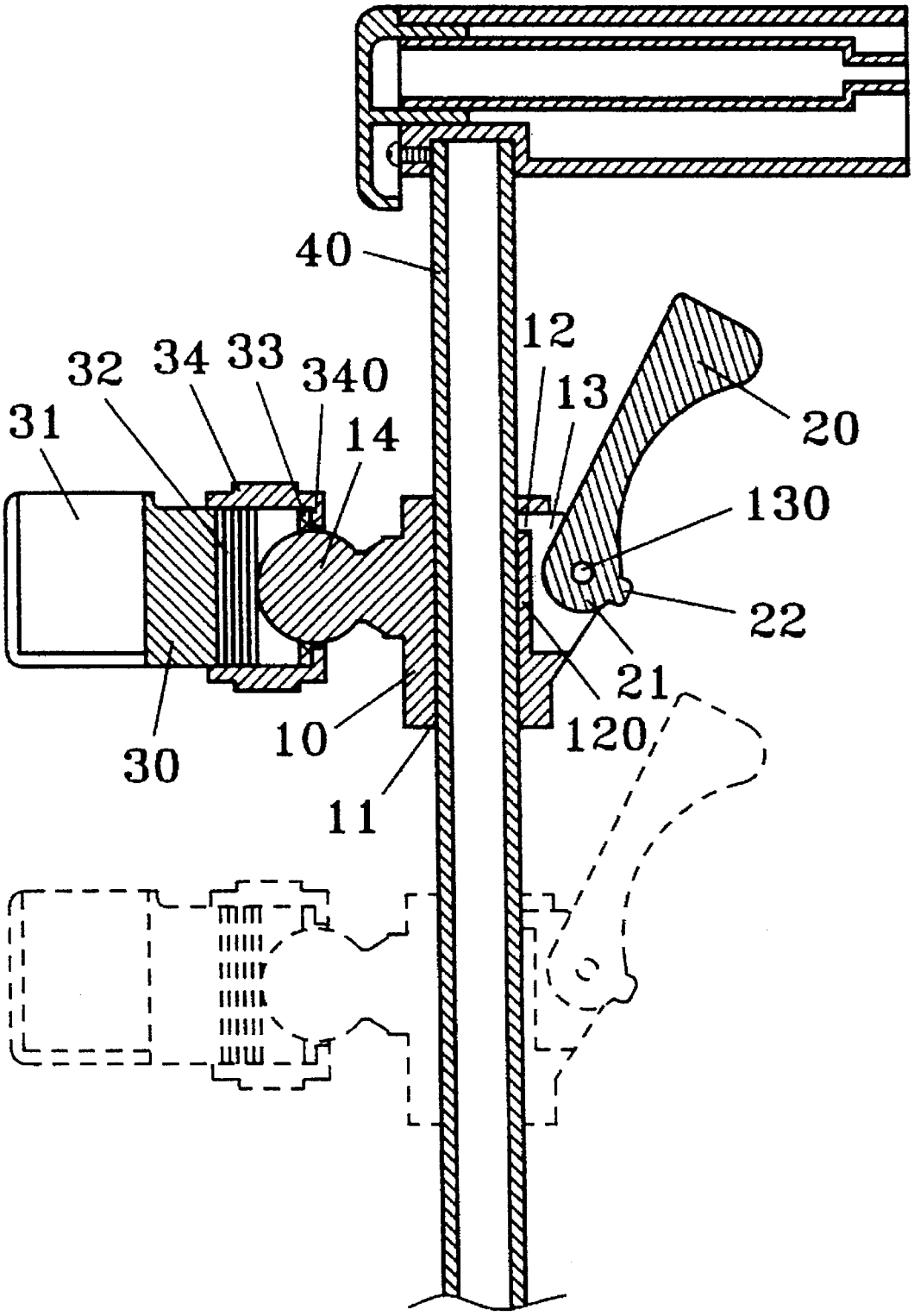
FIG. 6 is a cross-sectional view similar to FIG. 2, illustrating adjustment in height of the shower head holder assembly in accordance with the present invention.
Figure 7:
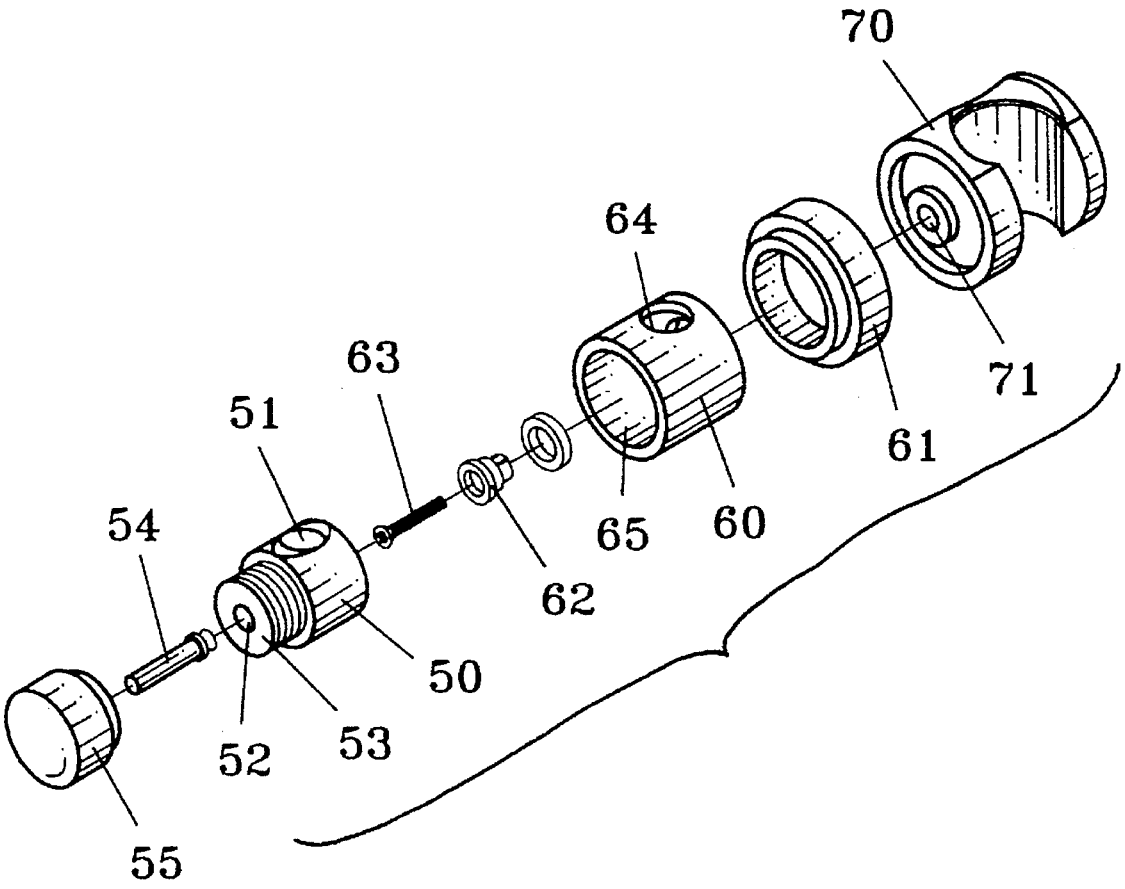
FIG.7 PRIOR ART
FIG. 7 is an exploded view of a shower head holder assembly according to prior art.
Figure 8:
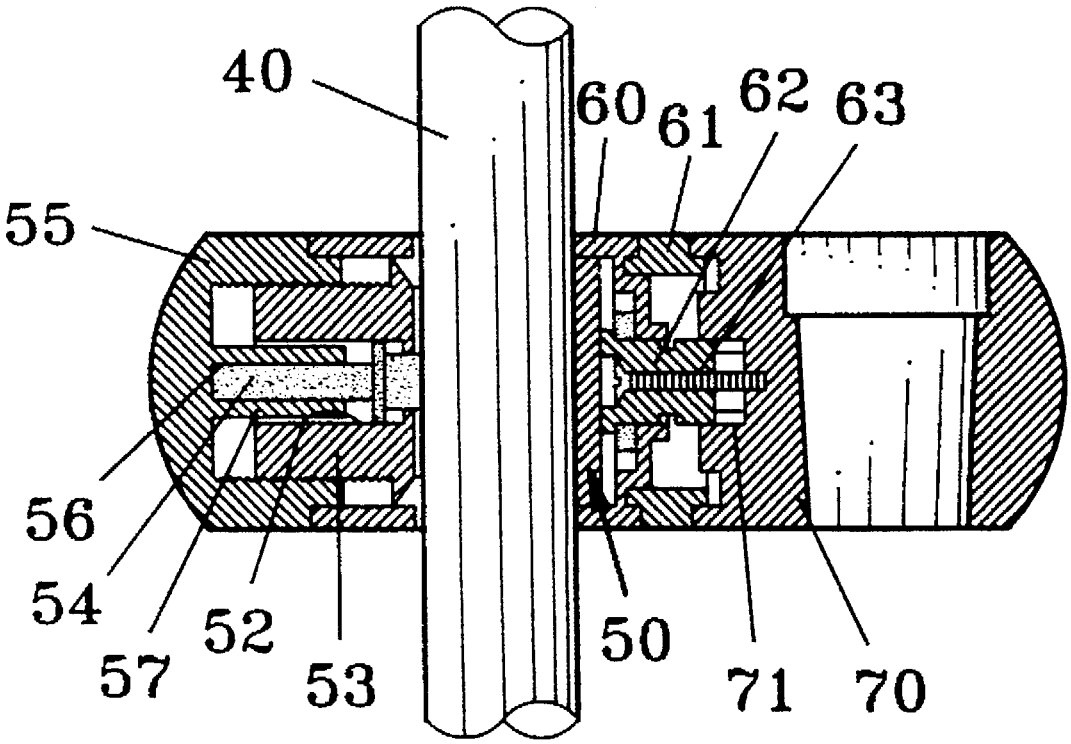
FIG.8 PRIOR ART
FIG. 8 is a cross-sectional view of the shower head holder assembly in FIG. 7.

The holder assembly is fixed relative to the vertical rod 40 when the lever 20 is in a first, secured position shown in FIG. 2, in which the eccentric operative edge 22 of the operative end 21 exerts a force to the flexible piece 120 to frictionally hold the vertical rod 40 in the positioning body 10. When the lever 20 is shifted to a second, released position shown by phantom lines in FIG. 4, the eccentric operative edge 22 disengages from the flexible piece 120, thereby allowing a height adjustment, as shown in FIG. 6. It is appreciated that adjustment of an angular position (in a horizontal plane) of the positioning body 10 can also be achieved when the lever 20 is in the released position.

Figure 5:
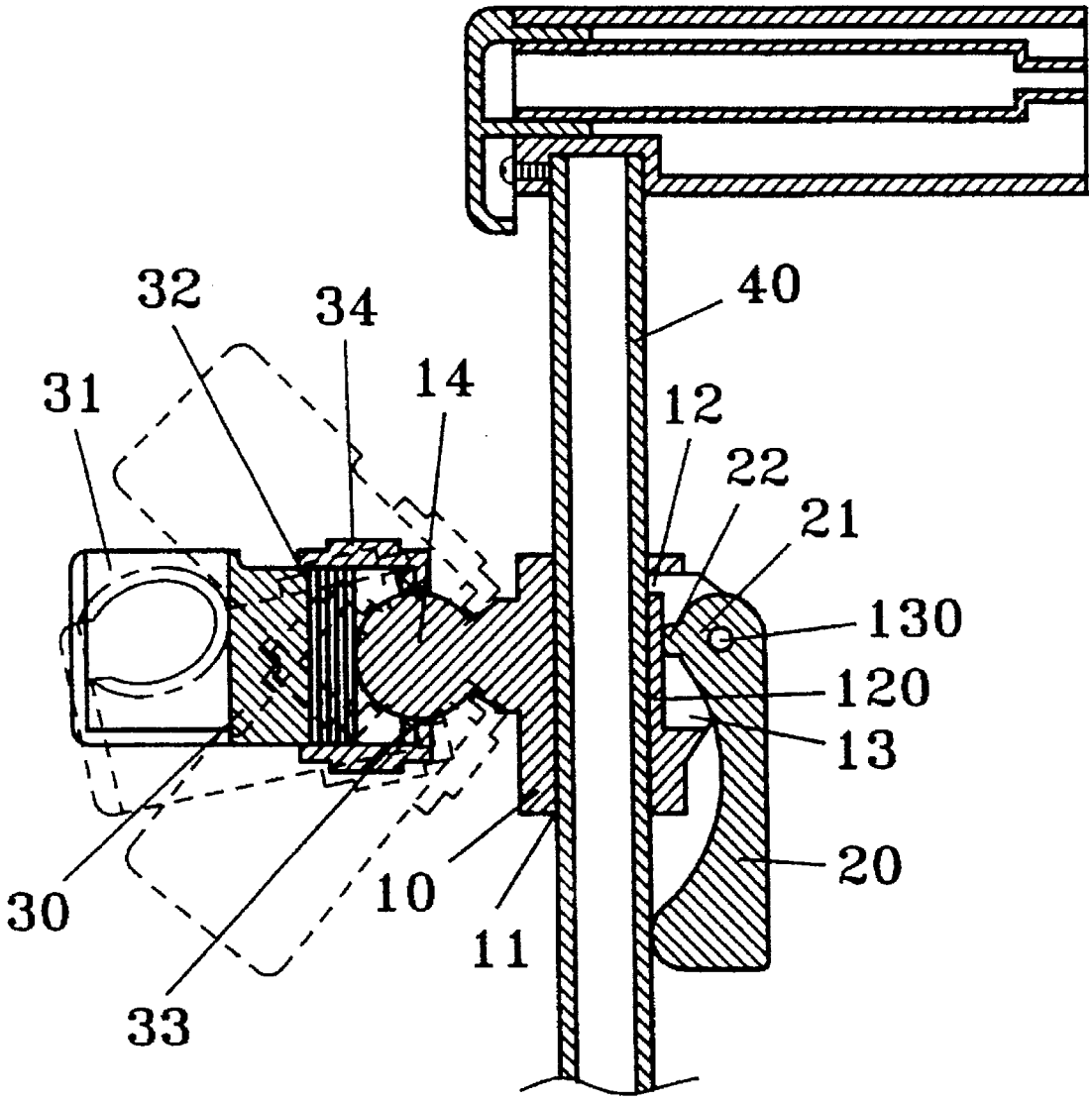
FIG. 5 is a cross-sectional view similar to FIG. 2, illustrating rotational adjustments of a holder of the shower head holder assembly in accordance with the present invention.

Referring to FIG. 5, the shower arm holder 30 is readily adjustable with respect to the positioning body 10 provided that a relatively large force, which is sufficient to overcome a frictional force between the sleeve 34 and the ball-like structure 14, is applied. As shown by the phantom lines (the middle one) in FIG. 5, the shower arm holder 30 is rotatable about a horizontal axis (as seen from the direction in FIG. 5). The shower arm holder 30 is also rotatable about an axis which is perpendicular to a plane on which the drawings sheet locates (shown by upper and lower phantom lines in FIG. 5). In other words, the ball-like structure 14 and the sleeve 34 act as a universal joint, providing a convenient operation in adjustment of the shower arm holder 30.

According to the above description, it is appreciated that the holder assembly of the present invention utilizes the lever 20 with the eccentric operative edge 22 to provide the required fixing function as well as easy adjustment, and the universal joint between the sleeve 34 and the ball-like structure 14 also provides a convenient adjustment. The overall structure is simple and easy for assembly, thereby reducing the labor hours and costs.

Although the invention has been explained in relation to its preferred embodiment, it is to be understood that many other possible modifications and variations can be made without departing from the spirit and scope of the invention as hereinafter claimed.

What is claimed is:

1. A holder assembly for a shower arm of a shower head, comprising:

a positioning body defining a vertical bore therein through which a vertical rod is adapted to extend, which, in turn, is mounted to a wall of a bathroom, the positioning body comprising an opening defined in an outer periphery thereof and in communication with the vertical bore, a pair of lugs being formed on the outer periphery of the positioning body and between which the opening is defined, a lever being pivotally connected to the lugs and including an operative end with an eccentric operative edge, the opening being substantially U-shaped, thereby forming a flexible piece therein; the eccentric operative edge exerts a force on the flexible piece so as to be frictionally held in position on the vertical rod when the lever is in a first, secured position, and the positioning body is movable relative to the vertical rod both in a longitudinal direction of the vertical rod and in an angular direction with respect to the vertical rod when the eccentric operative edge is in a second, released position in which the eccentric operative edge disengages from the flexible piece;

a connecting part extending from the outer periphery of the positioning body and including a ball-like structure;

a shower arm holder comprising a stub having a threaded outer periphery and a holder ring for removably holding a shower arm; and a means for attaching the shower arm holder to the connecting part of the positioning body, the attaching means including a sleeve having an inwardly-projecting annular edge formed on a first end thereof and an open second end with internal threading and a retainer ring having a diameter slightly smaller than a diameter of the ball-like structure and made of resilient material, said ball-like structure being partially received in the first end of the sleeve and having the retainer ring mounted adjacent to the inwardly-projecting annular edge of said sleeve to prevent the ball-like structure from disengaging from the sleeve, said stub of said shower arm holder being in threaded engagement with the open second end of the sleeve, thereby being attached to the ball-like structure and being universally adjustable relative to the ball-like structure.

* * * * *